US008240366B2

(12) United States Patent
Storey et al.

(10) Patent No.: US 8,240,366 B2
(45) Date of Patent: Aug. 14, 2012

(54) RADIANT COOLERS AND METHODS FOR ASSEMBLING SAME

(75) Inventors: James Michael Storey, Houston, TX (US); Aaron John Avagliano, Houston, TX (US); Ashley Nicole Gerbode, Houston, TX (US); Fulton Jose Lopez, Clifton Park, NY (US); Lien-Yan (Tom) Chen, Spring, TX (US); Judeth Helen Brannon Corry, Manvel, TX (US)

(73) Assignee: General Electric Company, Schenectady, NY (US)

( * ) Notice: Subject to any disclaimer, the term of this patent is extended or adjusted under 35 U.S.C. 154(b) by 255 days.

(21) Appl. No.: 11/899,043

(22) Filed: Aug. 31, 2007

(65) Prior Publication Data

US 2009/0041642 A1 Feb. 12, 2009

Related U.S. Application Data

(63) Continuation-in-part of application No. 11/835,158, filed on Aug. 7, 2007.

(51) Int. Cl.
*F22B 1/18* (2006.01)
*F28D 7/00* (2006.01)

(52) U.S. Cl. ..... 165/157; 122/7 R; 29/890.03

(58) Field of Classification Search ..... 165/146.157; 29/890.03

See application file for complete search history.

(56) References Cited

U.S. PATENT DOCUMENTS

| | | | | |
|---|---|---|---|---|
| 3,305,013 | A | | 2/1967 | Friedl et al. |
| 3,433,298 | A | | 3/1969 | Vollhardt |
| 3,648,768 | A | | 3/1972 | Scholl |
| 3,662,717 | A | | 5/1972 | Ter Haar |
| 4,029,054 | A | | 6/1977 | Schuurman |
| 4,098,324 | A | | 7/1978 | Kummel et al. |
| 4,187,902 | A | * | 2/1980 | Miller et al. ..... 165/76 |
| 4,245,479 | A | | 1/1981 | Richter, Jr. et al. |
| 4,270,493 | A | | 6/1981 | Blaskowski |
| 4,493,291 | A | | 1/1985 | Zabelka |
| 4,513,694 | A | * | 4/1985 | Wiemer ..... 122/7 R |
| 4,700,772 | A | * | 10/1987 | Baumberger ..... 165/103 |
| 4,768,470 | A | | 9/1988 | Ziegler |
| 4,936,376 | A | | 6/1990 | Martin et al. |
| 4,959,078 | A | | 9/1990 | Ziegler |

(Continued)

FOREIGN PATENT DOCUMENTS

DE 970031 C 8/1958

(Continued)

OTHER PUBLICATIONS

Mills, Anthony, Heat Transfer, ISBN 0-256-07642-1, 1992, pp. 85-89, and 94.

(Continued)

*Primary Examiner* — Allen Flanigan

(74) *Attorney, Agent, or Firm* — Armstrong Teasdale LLP

(57) ABSTRACT

A method of assembling a radiant cooler is provided. The method includes providing a vessel shell that includes a gas flow passage defined therein that extends generally axially through the vessel shell, coupling a plurality of cooling tubes and a plurality of downcomers together to form a tube cage wherein at least one of the plurality of cooling tubes is positioned circumferentially between a pair of circumferentially-adjacent spaced-apart downcomers, and orienting the tube cage within the vessel shell such that the tube cage is in flow communication with the flow passage.

17 Claims, 8 Drawing Sheets

U.S. PATENT DOCUMENTS

| | | | | |
|---|---|---|---|---|
| 5,233,943 | A | 8/1993 | Martin et al. | |
| 5,713,312 | A | 2/1998 | Waryasz | |
| 6,051,195 | A | 4/2000 | Deeke et al. | |
| 7,587,995 | B2 * | 9/2009 | Kraft et al. | 122/7 R |
| 7,730,616 | B2 * | 6/2010 | Goller et al. | 29/890.03 |
| 7,749,290 | B2 * | 7/2010 | Wallace | 48/89 |
| 2008/0175770 | A1 | 7/2008 | Wallace | |

FOREIGN PATENT DOCUMENTS

| | | | |
|---|---|---|---|
| DE | 3323818 | A1 | 1/1984 |
| FR | 1437831 | A | 7/1966 |
| GB | 729425 | * | 5/1955 |
| WO | 91/10106 | A1 | 7/1991 |
| WO | 91/10107 | A1 | 7/1991 |
| WO | 2007/055930 | A2 | 5/2007 |

OTHER PUBLICATIONS

U.S. Appl. No. 11/835,158, Office Action mailed Dec. 3, 2010, 23 pages.

WO Search Report issued in connection with corresponding WO Patent Application No. US08/068955 filed on Jul. 2, 2008.

* cited by examiner

RADIANT COOLERS AND METHODS FOR ASSEMBLING SAME

CROSS REFERENCE TO RELATED APPLICATIONS

This application is a continuation-in-part of U.S. patent application Ser. No. 11/835,158 filed Aug. 7, 2007, which is assigned to the same assignee of the present invention, and is hereby incorporated by reference.

BACKGROUND OF THE INVENTION

This invention relates generally to gasification systems, and more specifically to a radiant cooler.

At least some known gasification systems are integrated with at least one power-producing turbine system. For example, at least some known gasifiers convert a mixture of fuel, air or oxygen, steam, and/or limestone into an output of partially combusted gas, sometimes referred to as "syngas." The hot syngas may be supplied to a combustor of a gas turbine engine, which powers a generator that supplies electrical power to a power grid. Exhaust from at least some known gas turbine engines is supplied to a heat recovery steam generator that generates steam for driving a steam turbine. Power generated by the steam turbine also drives an electrical generator that provides electrical power to the power grid.

At least some known gasification systems use a separate gasifier that, in combination with the radiant cooler, facilitates gasifying feedstocks, recovering heat, and removing solids from the syngas to make the syngas more useable by other systems. Moreover, at least some known radiant coolers include a plurality of water-filled tubes that provide cooling to the syngas. One method of increasing the cooling potential of the radiant cooler requires increasing the number of water-filled tubes within the radiant cooler. However, increasing the number of water-filled tubes also increases the overall size and cost of the gasification system.

BRIEF DESCRIPTION OF THE INVENTION

In one aspect, a method of assembling a radiant cooler is provided. The method includes providing a vessel shell that includes a gas flow passage defined therein that extends generally axially through the vessel shell, coupling a plurality of cooling tubes and a plurality of downcomers together to form a tube cage wherein at least one of the plurality of cooling tubes is positioned circumferentially between a pair of circumferentially-adjacent spaced-apart downcomers, and orienting the tube cage within the vessel shell such that the tube cage is in flow communication with the flow passage.

In another aspect, a tube cage for use in a radiant cooler is provided. The tube cage includes a plurality of downcomers that extend substantially circumferentially about a center axis, and a plurality of cooling tubes that extend substantially circumferentially about the center axis, wherein at least one of the plurality of cooling tubes is positioned circumferentially between an adjacent pair of circumferentially-spaced downcomers.

In a further aspect, a radiant cooler is provided. The radiant cooler includes a vessel shell that extends substantially circumferentially about a center axis, and a tube cage coupled within the vessel shell, the tube cage comprising a plurality of downcomers that extend substantially circumferentially about a center axis, and a plurality of cooling tubes that extend substantially circumferentially about the center axis, wherein at least one of the plurality of cooling tubes is positioned circumferentially between an adjacent pair of circumferentially-spaced downcomers.

DETAILED DESCRIPTION OF THE INVENTION

The present invention generally provides exemplary syngas coolers to facilitate cooling syngas in an integrated gasification combined-cycle (IGCC) power generation system. The embodiments described herein are not limiting, but rather are exemplary only. It should be understood that the present invention may apply to any gasification system that includes a radiant cooler.

Figure 1:
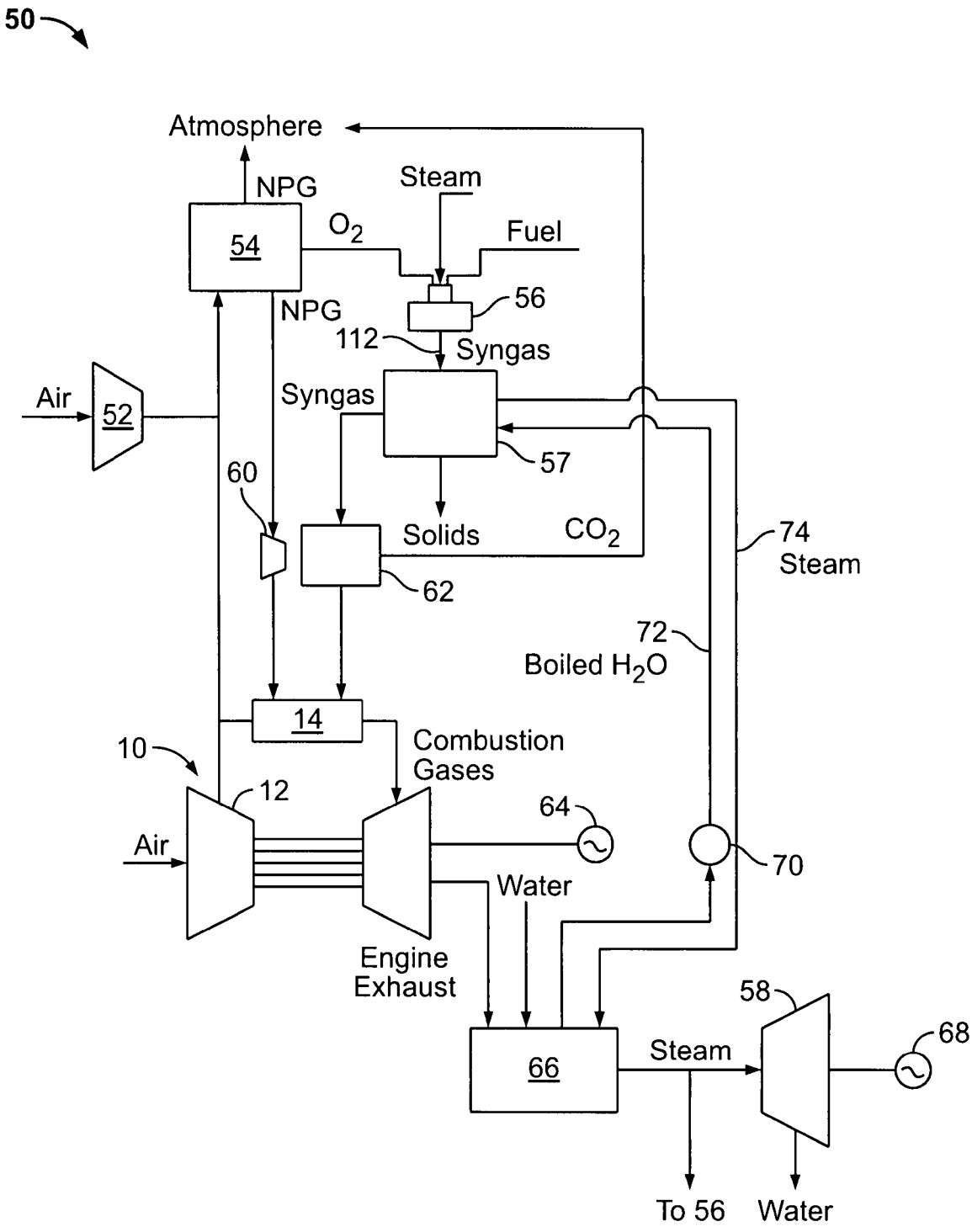
FIG. 1 is a schematic diagram of an exemplary integrated gasification combined-cycle (IGCC) power generation system.

FIG. 1 is a schematic diagram of an exemplary IGCC power generation system 50. IGCC system 50 generally includes a main air compressor 52, an air separation unit 54 coupled in flow communication to compressor 52, a gasifier 56 coupled in flow communication to air separation unit 54, a syngas cooler 57 coupled in flow communication to gasifier 56, a gas turbine engine 10 coupled in flow communication to syngas cooler 57, and a steam turbine 58.

In operation, compressor 52 compresses ambient air that is channeled to air separation unit 54. In some embodiments, in addition to compressor 52 or alternatively, compressed air from a gas turbine engine compressor 12 is supplied to air separation unit 54. Air separation unit 54 uses the compressed air to generate oxygen for use by gasifier 56. More specifically, air separation unit 54 separates the compressed air into separate flows of oxygen ($O_2$) and a gas by-product, sometimes referred to as a "process gas." The $O_2$ flow is channeled to gasifier 56 for use in generating partially combusted gases, referred to herein as "syngas," for use by gas turbine engine 10 as fuel, as described below in more detail. The process gas generated by air separation unit 54 includes nitrogen, referred to herein as "nitrogen process gas" (NPG). The NPG may also include other gases such as, but not limited to, oxygen and/or argon. For example, in some embodiments, the NPG includes between about 95% to about 100% nitrogen. In the exemplary embodiment, at least some of the NPG flow is vented to the atmosphere from air separation unit 54. Moreover, in the exemplary embodiment, some of the NPG flow is injected into a combustion zone (not shown) within gas turbine engine combustor 14 to facilitate controlling emissions of engine 10, and more specifically to facilitate reducing the combustion temperature and a nitrous oxide emissions of engine 10. IGCC system 50, in the exemplary embodiment, also includes a compressor 60 for compressing the NPG flow before injecting the NPG into combustor 14.

In the exemplary embodiment, gasifier 56 converts a mixture of fuel, $O_2$ supplied by air separation unit 54, steam, and/or limestone into an output of syngas 112 for use by gas turbine engine 10 as fuel. Although gasifier 56 may use any fuel, in the exemplary embodiment, gasifier 56 uses coal, petroleum coke, residual oil, oil emulsions, tar sands, and/or other similar fuels. Moreover, in the exemplary embodiment, syngas 112 generated by gasifier 56 includes carbon dioxide ($CO_2$).

Moreover, in the exemplary embodiment, syngas 112 generated by gasifier 56 is channeled to syngas cooler 57, which facilitates cooling syngas 112, as described in more detail below. Cooled syngas 112 is cleaned using a clean-up device 62 before syngas 112 is channeled to gas turbine engine combustor 14 for combustion thereof. In the exemplary embodiment, $CO_2$ may be separated from syngas 112 during cleaning and may be vented to the atmosphere, captured, and/or partially returned to gasifier 56. Gas turbine engine 10 drives a generator 64 that supplies electrical power to a power grid (not shown). Exhaust gases from gas turbine engine 10 are channeled to a heat recovery steam generator 66 that generates steam for driving steam turbine 58. Power generated by steam turbine 58 drives an electrical generator 68 that provides electrical power to the power grid. In the exemplary embodiment, steam from heat recovery steam generator 66 is also supplied to gasifier 56 for generating syngas.

Furthermore, in the exemplary embodiment, system 50 includes a pump 70 that supplies feed water 72 from steam generator 66 to syngas cooler 57 to facilitate cooling syngas 112 channeled therein from gasifier 56. Feed water 72 is channeled through syngas cooler 57, wherein feed water 72 is converted to a steam 74, as described in more detail below. Steam 74 is then returned to steam generator 66 for use within gasifier 56, syngas cooler 57, steam turbine 58, and/or other processes in system 50.

Figure 2:
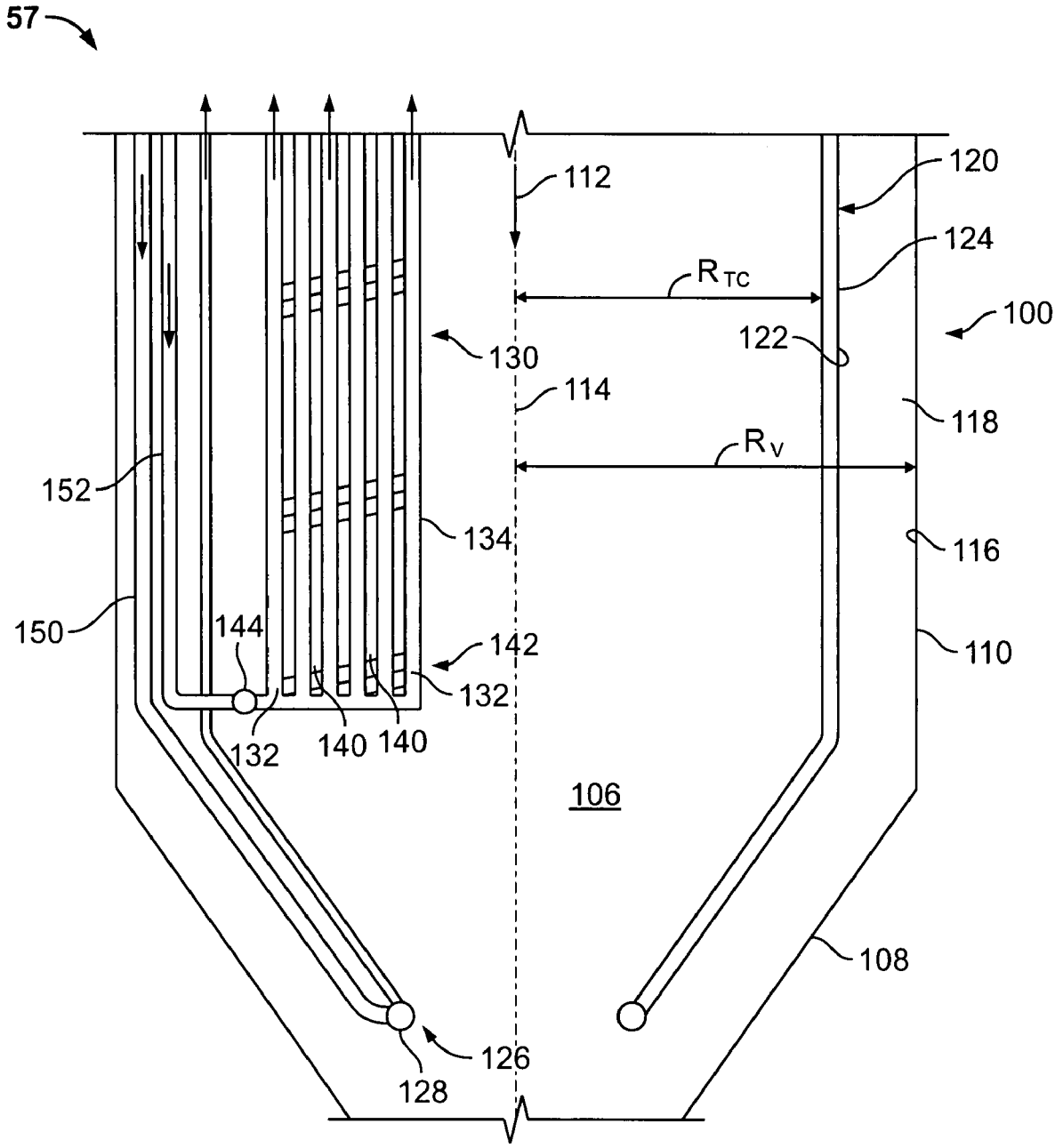
FIG. 2 is a schematic cross-sectional view of an exemplary syngas cooler that may be used with the system shown in FIG. 1.

FIG. 2 is a schematic cross-sectional view of an exemplary syngas cooler 57 that may be used with a gasification system, such as IGCC system 50 (shown in FIG. 1). In the exemplary embodiment, syngas cooler 57 is a radiant syngas cooler. Alternatively, syngas cooler 57 may be any type of tube and shell heat exchanger that enables system 50 to function as described herein. In the exemplary embodiment, syngas cooler 57 includes a pressure vessel shell 100 having an upper shell (not shown), a lower shell 108, and a vessel body 110 extending therebetween. In the exemplary embodiment, vessel shell 100 is substantially cylindrical-shaped and defines an inner chamber 106 within syngas cooler 57. Moreover, vessel shell 100 is fabricated from a pressure quality material, for example, but not limited to, a chromium molybdenum steel. Accordingly, the material used in fabricating shell 100 enables shell 100 to withstand a pressure of syngas 112 within syngas cooler 57. Moreover, in the exemplary embodiment, syngas cooler 57 is fabricated with a radius $R_V$ that extends from a center axis 114 to an inner surface 116 of vessel shell 100. In the exemplary embodiment, gasifier 56 (shown in FIG. 1) is coupled in flow communication with syngas cooler 57 such that syngas 112 discharged from gasifier 56 is injected through an inlet (not shown) into syngas cooler 57, and more specifically, into inner chamber 106, as described in more detail below.

In the exemplary embodiment, syngas cooler 57 also includes an annular membrane wall, or tube cage, 120 that is coupled within chamber 106. In the exemplary embodiment, tube cage 120 is aligned substantially co-axially with center axis 114 and is formed with a radius $R_{TC}$ that extends from center axis 114 to an outer surface 122 of tube cage 120. In the exemplary embodiment, radius $R_{TC}$ is shorter than radius $R_V$. More specifically, in the exemplary embodiment, tube cage 120 is aligned substantially co-axially and extends generally axially within syngas cooler 57. As a result, in the exemplary embodiment, a substantially cylindrical-shaped gap 118 is defined between inner surface 116 of vessel shell 100 and radially outer tube cage surface 122.

In the exemplary embodiment, tube cage 120 includes a plurality of water tubes, or cooling tubes, 124 that each extend axially through a portion of syngas cooler 57. Specifically, in the exemplary embodiment, each tube cage cooling tube 124 has an outer surface (not shown) and an opposite inner surface (not shown) that defines an inner passage (not shown) extending axially therethrough. More specifically, the inner passage of each tube cage cooling tube 124 enables cooling fluid to be channeled therethrough. In the exemplary embodiment, the cooling fluid channeled within each tube cage cooling tube 124 is feed water 72. Alternatively, the cooling fluid channeled within each tube cage cooling tube 124 may be any cooling fluid that is suitable for use in a syngas cooler. Moreover, in the exemplary embodiment, at least one pair of adjacent circumferentially-spaced apart cooling tubes 124 are coupled together using a web portion (not shown). In the exemplary embodiment, tube cage cooling tubes 124 are fabricated from a material that facilitates heat transfer, such as, but not limited to, chromium molybdenum steel, stainless steel, and other nickel-based alloys. Specifically, a downstream end 126 of each cooling tube 124 is coupled in flow communication to an inlet manifold 128. Similarly, in the exemplary embodiment, an upstream end (not shown) of each tube cage cooling tube 124 is coupled in flow communication to a tube cage riser (not shown).

Syngas cooler 57, in the exemplary embodiment, includes at least one heat transfer panel, or platen 130, that extends generally radially from tube cage 120 towards center axis 114. Alternatively, each platen 130 may extend away from tube cage 120 at any angle θ (not shown in FIG. 2) that enables tube cage 120 to function as described herein. Specifically, in the exemplary embodiment, each platen 130 includes a plurality of cooling tubes 132 that extend generally axially through syngas cooler 57. Each platen cooling tube 132 includes an outer surface 134 and an inner surface 136 (not shown in FIG. 2) that defines an inner passage 138 (not shown in FIG. 2) that extends axially through platen cooling tube 132. In the exemplary embodiment, at least one pair of generally radially-spaced platen cooling tubes 132 are coupled together using a web portion 140 to form each platen 130. Moreover, in the exemplary embodiment, platen cooling tubes 132 are fabricated from a material that facilitates heat transfer, such as, but not limited to, chromium molybdenum steel, stainless steel, and other nickel-based alloys. In the exemplary embodiment, each platen cooling tube 132 includes a downstream end 142 that is coupled in flow communication with a platen inlet manifold 144. Similarly, in the exemplary embodiment, an upstream end (not shown) of each platen cooling tube 132 is coupled in flow communication to a platen riser 148 (not shown in FIG. 2).

In the exemplary embodiment, syngas cooler 57 also includes a plurality of tube cage downcomers 150 and a plurality of platen downcomers 152 that each extend generally axially within gap 118. Specifically, downcomers 150 and 152 each include an inner surface (not shown) that defines an inner passage (not shown) that extends generally axially through each downcomer 150 and 152. More specifically, in the exemplary embodiment, each tube cage downcomer 150 is coupled in flow communication with tube cage inlet manifold 128, and each platen downcomer 152 is coupled in flow communication with platen inlet manifold 144.

During operation, in the exemplary embodiment, each tube cage downcomer 150 channels a flow of feed water 72 to tube cage inlet manifold 128, and more specifically, to each tube cage cooling tube 124. Similarly, each platen downcomer 152 channels feed water 72 to platen inlet manifold 144, and more specifically, to each platen cooling tube 132. Specifically, to facilitate enhanced cooling of syngas 112, in the exemplary embodiment, feed water 72 is channeled upstream, with respect to the flow of syngas 112 through syngas cooler 57. Heat from syngas 112 is transferred from the flow of syngas 112 to the flow of feed water 72 channeled through each cooling tube 124 and 132. As a result, feed water 72 is converted to steam 74 and the syngas 112 is facilitated to be cooled. Specifically, in the exemplary embodiment, heat from syngas 112 is transferred from the syngas 112 to the flow of feed water 72 such that feed water 72 is converted to steam 74. The steam 74 produced is channeled through each cooling tube 124 and platen cooling tube 132 towards tube cage risers (not shown) and platen risers 148, respectively, wherein the steam 74 is discharged from syngas cooler 57.

Figure 3:
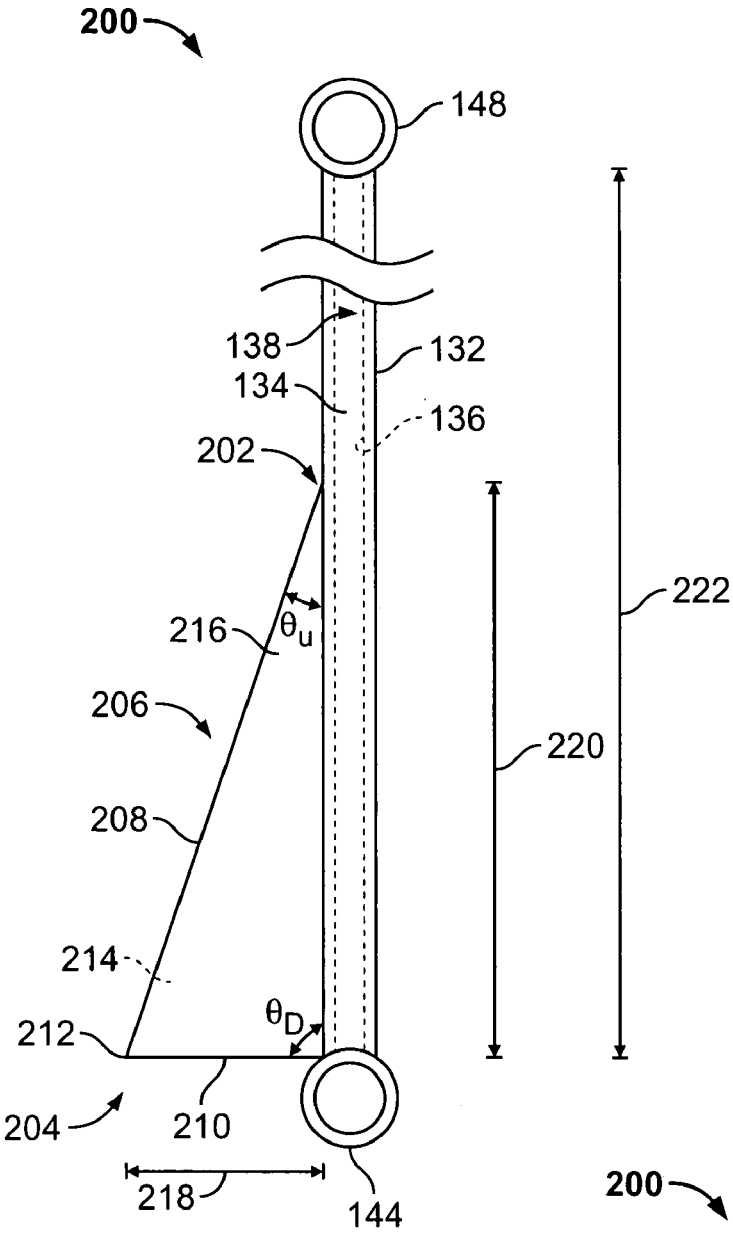
FIG. 3 is a side-view of an exemplary cooling fin that may be used with the syngas cooler shown in FIG. 2.
Figure 4:
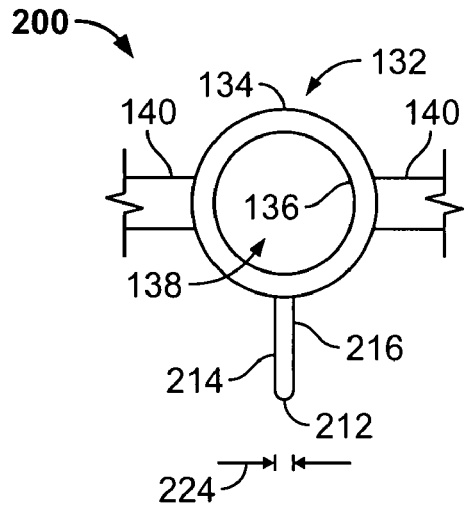
FIG. 4 is a cross-sectional top-view of the cooling fin shown in FIG. 3.

FIG. 3 is a schematic side-view of a cooling fin 200 extending outward from a cooling tube, such as platen cooling tube 132. FIG. 4 is a cross-sectional top-view of cooling fin 200. In the exemplary embodiment, at least one cooling fin 200 extends away from platen cooling tube 132. Alternatively, at least one cooling fin 200 extends away from at least one of cooling tube 124 and platen cooling tube 132. In the exemplary embodiment, cooling fin 200 includes an upstream end 202, a downstream end 204, and a body 206 extending therebetween. Body 206 is formed in the exemplary embodiment with an upstream edge 208, a downstream edge 210, and a tip portion 212 that extends therebetween. Moreover, in the exemplary embodiment, cooling fin 200 also includes a first side surface 214 and a second side surface 216.

In the exemplary embodiment, upstream end 202 is substantially flush with outer surface 134 and downstream end 204 extends a distance 218 away from outer surface 134. In known syngas coolers, particulate matter entrained within syngas 112 may cause a build-up, or foul, components within syngas cooler 57. As described in more detail below, each cooling fin 200 facilitates reducing such fouling by extending outward from outer surface 134 at an angle $\theta_U$ to facilitate removing fouled material during transient events, such as, but not limited to, temperature and/or pressure transients. More specifically, in the exemplary embodiment, each cooling fin 200 is formed along each platen cooling tube 132 at a distance (not shown) from syngas cooler inlet (not shown), wherein the orientation and relative location of such fins 200 facilitates reducing fouling of each cooling tube 132. For example, in one embodiment, each cooling fin 200 extends generally along the total length 222 of each platen cooling tube 132. In another embodiment, each cooling fin 200 extends across only a portion of each respective cooling tube 132, such as for example between about 0% to about 66%, or between about 0% to about 33% of length 222, as measured from downstream end 142 of platen cooling tube 132.

Moreover, in the exemplary embodiment, each cooling fin upstream edge 208 extends outward from platen cooling tube outer surface 134 at angle $\theta_U$. Generally, angle $\theta_U$ is between about 1° to about 40° measured with respect to outer surface 134. In the exemplary embodiment, angle $\theta_U$ is about 30°. Similarly, downstream edge 210 extends outward from outer surface 134 at an angle $\theta_D$. Generally, angle $\theta_D$ is between about 40° to about 135° measured with respect to outer surface 134. In the exemplary embodiment, angle $\theta_D$ is about 90°.

Cooling fin 200, in the exemplary embodiment, has a thickness 224 measured between first side surface 214 and second side surface 216 of cooling fin 200. In the exemplary embodiment, thickness 224 is generally constant along cooling fin body 206 from upstream edge 208 to tip portion 212. Alternatively, thickness 224 may vary along cooling fin body 206. For example, in an alternative embodiment, cooling fin 200 may have a first thickness defined generally at one fin end 202 or 212, and a second thickness defined generally at the other fin end 212 or 202. Moreover, in another embodiment, fin body 206 may taper from upstream edge 208 to tip portion 212 or vice-versa.

The number, the orientation, and the dimensions of cooling fins 200, is based on an amount of heat desired to be transferred from the syngas 112 to feed water 72. Generally, a total surface area defined by cooling tubes 124 and 132, or heat transfer surface area (not shown), is substantially proportional to the amount of heat transferred from the flow of syngas 112 to the flow of feed water 72. Accordingly, increasing the number of cooling fins 200 facilitates reducing the temperature of syngas 112 discharged from syngas cooler 57 as the surface area (not shown) of each corresponding platen cooling tube 132 is increased. Moreover, increasing the heat transfer surface area enables an overall length and/or radius $R_1$ of syngas cooler 57 to be reduced without adversely affecting the amount of heat transferred from the flow of syngas 112. Reducing the overall length and/or radius $R_1$ of syngas cooler 57 facilitates reducing the size and cost of syngas cooler 57. As a result, increasing the heat transfer surface area within syngas cooler 57 by adding at least one cooling fin 200 enables the overall length and/or radius $R_1$ of syngas cooler 57 to be reduced. As such, the size and cost of syngas cooler 57 is facilitated to be reduced.

Figure 5:
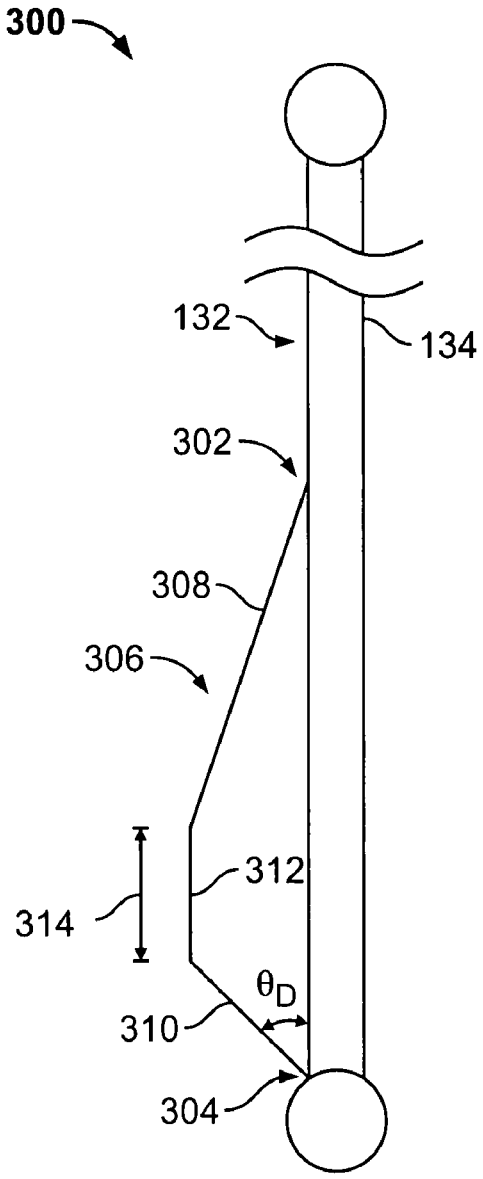
FIG. 5 is a side-view of an alternative embodiment of a cooling fin that may be used with the syngas cooler shown in FIG. 2.

FIG. 5 is a side-view of an alternative cooling fin 300 that may be used with syngas cooler 57 (shown in FIG. 2). Components of cooling fin 300 are substantially similar to components of cooling fin 200, and like components are identified with like reference numerals. More specifically, cooling fin 300 and cooling fin 200 are substantially similar except that in the exemplary embodiment, each cooling fin 300 is also formed with a tip portion 312 having a length 314. In the exemplary embodiment, each cooling fin 300 is formed with an upstream end 302, a downstream end 304, and a body 306 that extends therebetween. Specifically, in the exemplary embodiment, body 306 includes an upstream edge 308, a downstream edge 310, and a tip portion 312 extending therebetween. In the exemplary embodiment, downstream edge 310 extends outward from outer surface 134 towards tip portion 312 at an angle $\theta_D$. Generally, angle $\theta_D$ is between about 40° to about 135° measured with respect to outer surface 134. In the exemplary embodiment, angle $\theta_D$ is about 45°. Moreover, in the exemplary embodiment, tip portion 312 has a length 330 measured from upstream edge 308 to downstream edge 310.

Figure 6:
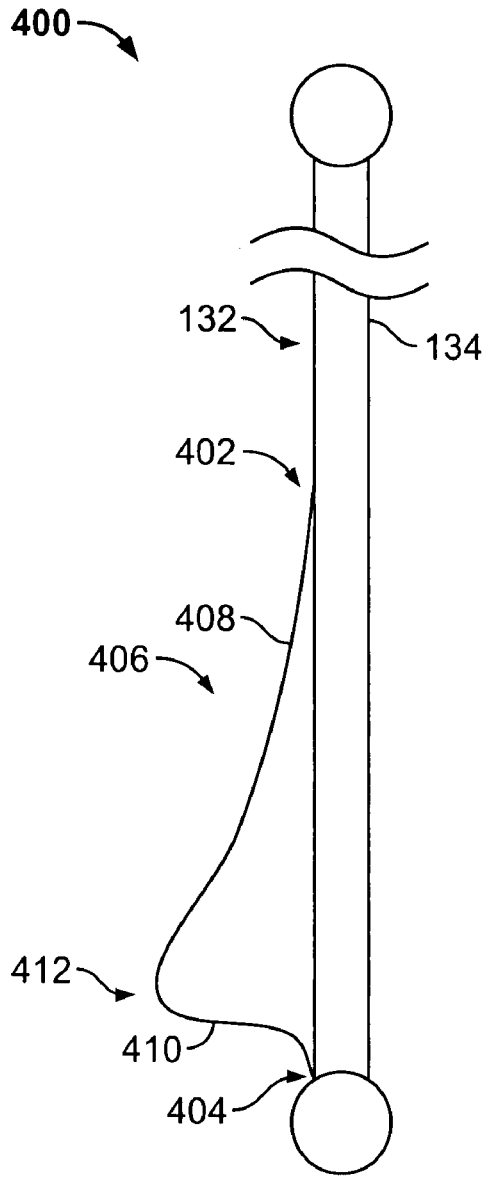
FIG. 6 is a side-view of yet another alternative embodiment of a cooling fin that may be used within the syngas cooler shown in FIG. 2.

FIG. 6 is a side-view of another alternative cooling fin 400 that may be used with syngas cooler 57 (shown in FIG. 2). Components of cooling fin 400 are substantially similar to components of cooling fin 200, and like components are identified with like reference numerals. More specifically, cooling fin 400 and cooling fin 200 are substantially similar except that in the exemplary embodiment, cooling fin 400 is formed with a curved upstream edge 408, a curved downstream edge 410, and a rounded tip portion 412 extending therebetween. In the exemplary embodiment, cooling fin 400 includes an upstream end 402, a downstream end 404, and a body 406 that extends therebetween. Specifically, in the exemplary embodiment, body 406 is formed with an upstream edge 408, downstream edge 410, and a tip portion 412 extending therebetween. In the exemplary embodiment, downstream edge 410 extends arcuately from outer surface 134 of platen cooling tube 132 towards tip portion 412. Moreover, in the exemplary embodiment, downstream edge 410 extends arcuately from outer surface 143 towards tip portion 412. Further, in the exemplary embodiment, tip portion 412 is substantially rounded and extends arcuately between upstream edge 408 and downstream edge 410.

During operation, in the exemplary embodiment, syngas 112 is discharged from gasifier 56 into chamber 106 through syngas cooler inlet (not shown), and more specifically, into tube cage 120. Syngas cooler 57, in the exemplary embodiment, includes at least one platen 130 that extends generally radially outward from tube cage 120 towards center axis 114. Specifically, in the exemplary embodiment, the flow of syngas 112 is channeled over outer surface 134 and at least one cooling fin 200 extending therefrom. Alternatively, syngas cooler 57 includes at least one cooling fin 200 that extends outward from at least one of cooling tube 124 and platen cooling tube 132. In the exemplary embodiment, syngas 112 is channeled over first and second side surfaces 214 and 216, respectively, to facilitate transferring heat from the flow of syngas 112 to the flow of feed water 72. Moreover, in the exemplary embodiment, cooling fins 200 facilitate increasing the heat transfer surface area of each platen cooling tube 132. As a result, in the exemplary embodiment, increasing the heat transfer surface area facilitates at least one of increasing the heat transferred from the flow of syngas 112 to the flow of feed water 72, and reducing the overall length and/or radius $R_1$ of syngas cooler 57.

Moreover, during operation, syngas 112 discharged from gasifier 56 may contain particulate matter therein. In some known syngas coolers, particulate matter may cause a build-up on, or foul, components within syngas cooler 57. The fouling on components within syngas cooler 57, such as cooling tubes 132, facilitates reducing the amount of heat transferred from the flow of syngas 112 to the flow of feed water 72. Accordingly, in the exemplary embodiment, cooling fin upstream edge 208 extends outward from platen cooling tube 132 at angle $\theta_U$ to facilitate reducing fouling on cooling tube 132. Specifically, in the exemplary embodiment, angle $\theta_U$ is oriented such that fouling falls off cooling tube 132 or reduced the accumulation of fouling thereon.

As described above, in the exemplary embodiment, at least one cooling fin 200 facilitates cooling the flow of syngas 112 by increasing the heat transfer surface area of at least one platen cooling tube 132. Specifically, in the exemplary embodiment, each cooling fin 200 extends outward from outer surface 134. As such, in the exemplary embodiment, each cooling fin 200 extends substantially into the flow of syngas 112. As a result, in the exemplary embodiment, the flow of syngas 112 is channeled over both platen cooling tubes 132 and at least one cooling fin 200, both of which facilitate transferring heat from the flow of syngas 112 to the flow of feed water 72 channeled through each platen cooling tube 132. Accordingly, a temperature of the flow of syngas 112 is facilitated to be reduced. Moreover, as described above, increasing the heat transfer surface area enables the overall length and/or radius $R_1$ of syngas cooler 57 to be reduced without adversely affecting the amount of heat transferred from the flow of syngas 112.

The above-described methods and apparatus facilitate cooling syngas channeled through a syngas cooler by positioning at least one cooling fin extending outward from at least one cooling tube into the flow of the syngas. The cooling fin facilitates increasing the heat transfer surface area of the cooling tube, thus increasing heat transfer between the syngas flowing past that cooling tube and the feed water flowing through that cooling tube. Moreover, increasing the surface area of a plurality of cooling tubes enables the overall size of the syngas cooler to be reduced without reducing an amount of heat transfer in the cooler. Specifically, increasing the surface area of each cooling tube also facilitates reducing the overall length and radius of the syngas cooler. As a result, increasing the surface area of each cooling tube facilitates reducing the overall size and cost of the syngas cooler.

Moreover, the above-described methods and apparatus facilitate reducing particulate matter within the syngas from building up on, or fouling, each associated cooling tube. Specifically, each cooling fin is formed with an upstream end, a downstream end, and a body extending therebetween. More specifically, the body includes an upstream edge, a downstream edge, and a tip portion extending therebetween. The upstream edge extends outward from the platen cooling tube at an angle of about 30° to facilitate reducing fouling on each cooling tube, which facilitates increasing heat transfer from the flow of syngas to the flow of cooling fluid channeled through each corresponding platen cooling tube.

Figure 7:
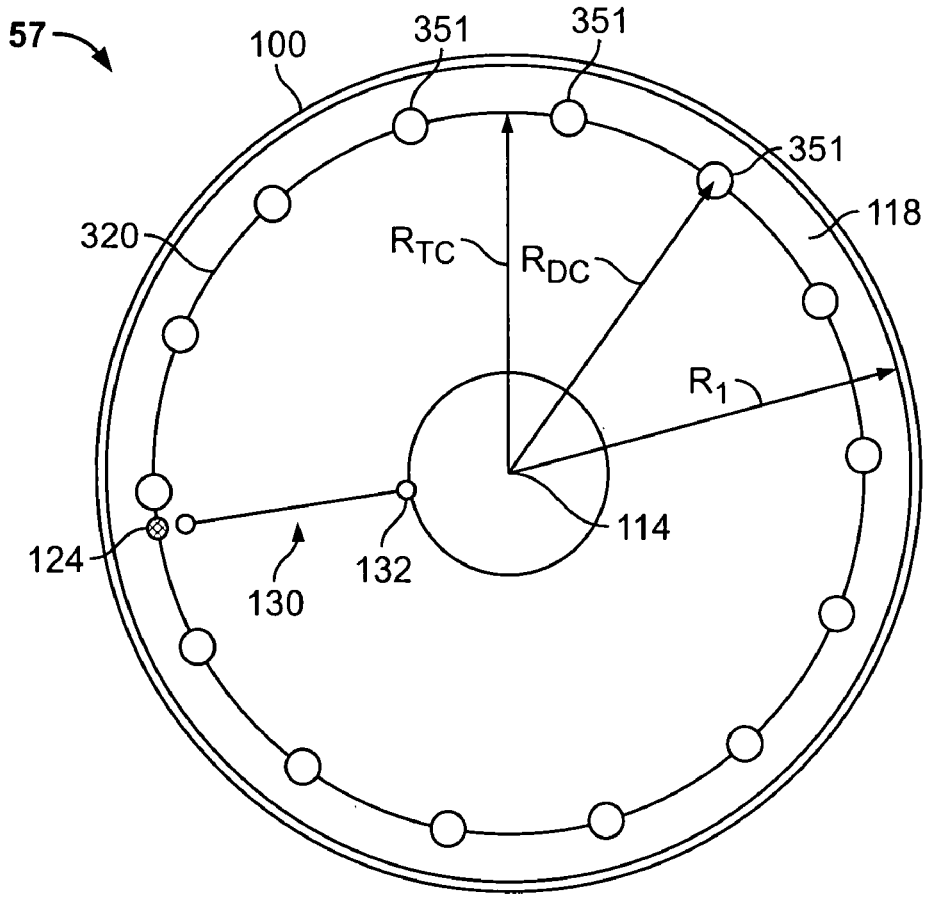
FIG. 7 is a cross-sectional plan-view of an alternative embodiment of a tube cage that may be used with the syngas cooler shown in FIG. 2.

FIG. 7 is a cross-sectional plan-view of an alternative tube cage 320 that may be used with syngas cooler 57 (shown in FIG. 2). Components of tube cage 320 that are identical to components of tube cage 120 are identified with the same reference numerals. More specifically, tube cage 320 and tube cage 120 are substantially similar except that tube cage 320 also includes a plurality of downcomers 351 defined therein. Specifically, in the exemplary embodiment, tube cage 320 is aligned substantially co-axially with center axis 114 and is formed such that each cooling tube 124 and each downcomer 351 extends generally axially through a portion of syngas cooler 57. Moreover, each downcomer 351 includes an inner surface (not shown) that defines an inner passage (not shown) that channels cooling fluid generally axially therethrough. Moreover, in the exemplary embodiment, each downcomer 351 is coupled in flow communication with at least one of the tube cage cooling tubes 124 and the platen cooling tubes 132, such that each downcomer 351 channels feed water 72 (not shown in FIG. 7) to either the tube cage cooling tubes 124 and/or the platen cooling tubes 132.

In the exemplary embodiment, at least one tube cage cooling tube 124 extends between each pair of adjacent circumferentially-spaced downcomers 351. Moreover, each downcomer 351 and each tube cage cooling tube 124 is located at a radius $R_{DC}$ and $R_{CT}$, respectively, measured from center axis 114. Specifically, in the exemplary embodiment, each downcomer 351 is positioned in tube cage 320 at a location such that radius $R_{CT}$ is substantially equal to radius $R_{DC}$. Tube cage 320 enables each downcomer 351 to be positioned closer to center axis 114, as compared to known coolers. As a result, a gap 118 defined between vessel shell 100 and tube cage 320 is facilitated to be reduced, in comparison to known coolers. Moreover, shell radius $R_V$ is reduced in comparison to known vessel shell radii. Moreover, positioning the plurality of downcomers 351 within tube cage 320 facilitates reducing shell radius $R_V$ without reducing the amount of heat exchange surface area of tube cage 320. Furthermore, reducing the radius $R_V$ of shell 100 facilitates reducing the size, thickness, and manufacturing costs of syngas cooler 57.

During operation, in the exemplary embodiment, each downcomer 351 channels feed water 72 to either the tube cage cooling tubes 124 and/or the platen cooling tubes 132. Specifically, each downcomer 351 channels feed water 72 downstream with respect to the flow of syngas 112 and each tube cage cooling tube 124 channels feed water 72 upstream with respect to the flow of syngas 112 to facilitate enhanced cooling of syngas 112. Heat from syngas 112 is transferred from syngas 112 to the flow of feed water 72 channeled through downcomers 351 and cooling tubes 124 and 132. As a result, feed water 72 is converted to steam 74 (not shown in FIG. 7) as heat from syngas 112 is transferred to the flow of feed water 72.

Figure 8:
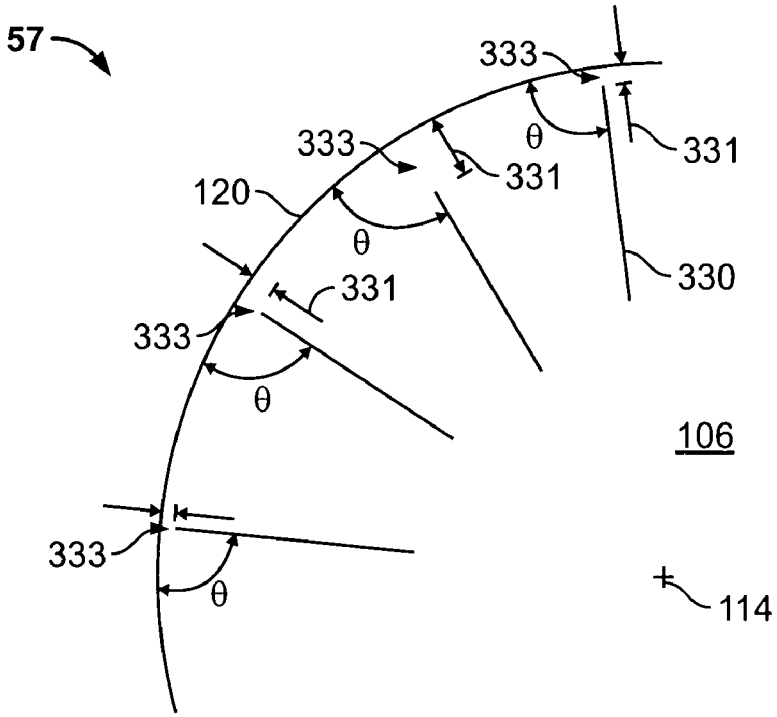
FIG. 8 is an enlarged cross-sectional plan-view of a plurality of platens that may be used with the syngas cooler shown in FIG. 2.
Figure 9B:
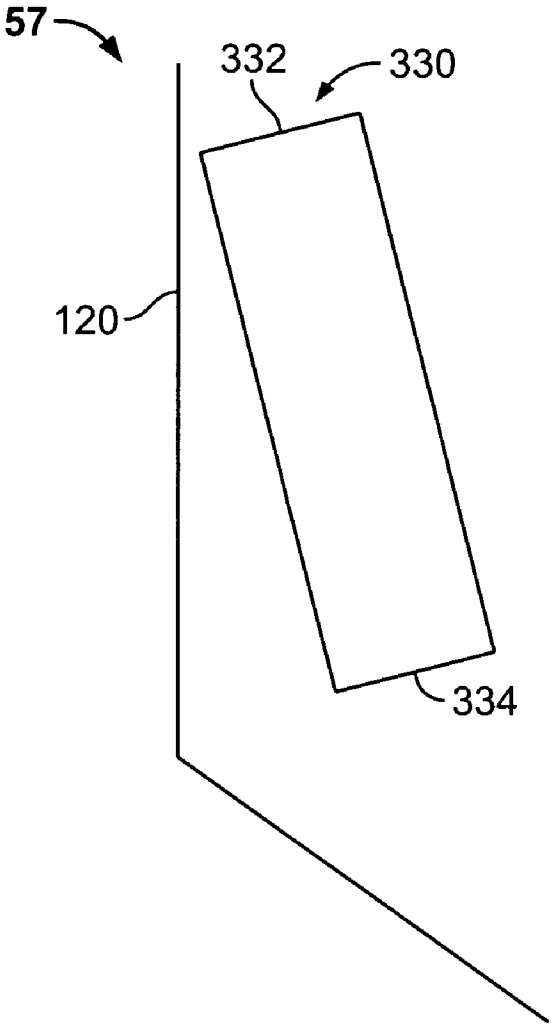
FIGS. 9A and 9B are side-views of one of the platens shown in FIG. 8 that may be used with the syngas cooler shown in FIG. 2.
Figure 9A:
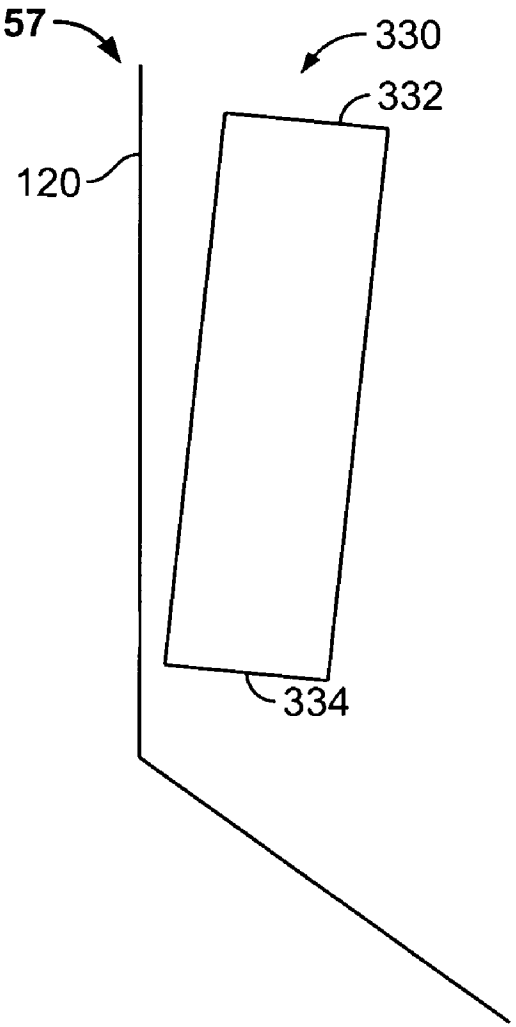

FIG. 8 is an enlarged cross-sectional plan-view of an alternative plurality of platens 330 that may be used with syngas cooler 57 (shown in FIG. 2). FIGS. 9A and 9B are partial side-views of tube cage 120 including at least one platen 330. Components of platens 330 that are identical to components of platens 130 are identified with the same reference numerals. Syngas cooler 57, in the exemplary embodiment, includes a plurality of platens 330 that each extend generally radially from tube cage 120 towards center axis 114. Alternatively, each platen 330 may extend, but is not limited to extending, arcuately, sinusoidally, and/or in segments, from tube cage 120. In the exemplary embodiment, each platen 330 is spaced a distance 331 from tube cage 120 such that a gap 333 is defined therebetween. Specifically, in the exemplary embodiment, distance 331 for at least one platen 330 is different than distance 331 for at least one other platen 330. As a result, at least one platen 330 is closer to tube cage 120 than at least one other platen 330. Moreover, in the exemplary embodiment, each platen 330 within tube cage 320 is aligned substantially parallel with respect to tube cage 120. Alternatively, at least one platen 330 may be oriented with respect to tube cage 120 such that either a platen upstream end 332 or a platen downstream end 334 is obliquely oriented with respect to tube cage 120.

During operation, syngas 112 discharged from gasifier 56 (not shown in FIG. 8) into chamber 106 is discharged into syngas cooler 57 generally parallel to center axis 114. As a result, the flow of syngas 112 is substantially greater near center axis 114 than adjacent to tube cage 120. In the exemplary embodiment, because at least one platen 330 is spaced closer to center axis 114 than at least one other platen 330, more platen cooling tubes 332 are positioned closer to center axis 114 as compared to known coolers. As a result, the heat transferred from the flow of syngas 112 to the flow of feed water 72 is facilitated to be increased in such an embodiment. Moreover, and as described above, the overall length and/or radius $R_V$ of syngas cooler 57 is also facilitated to be reduced.

Figure 10:
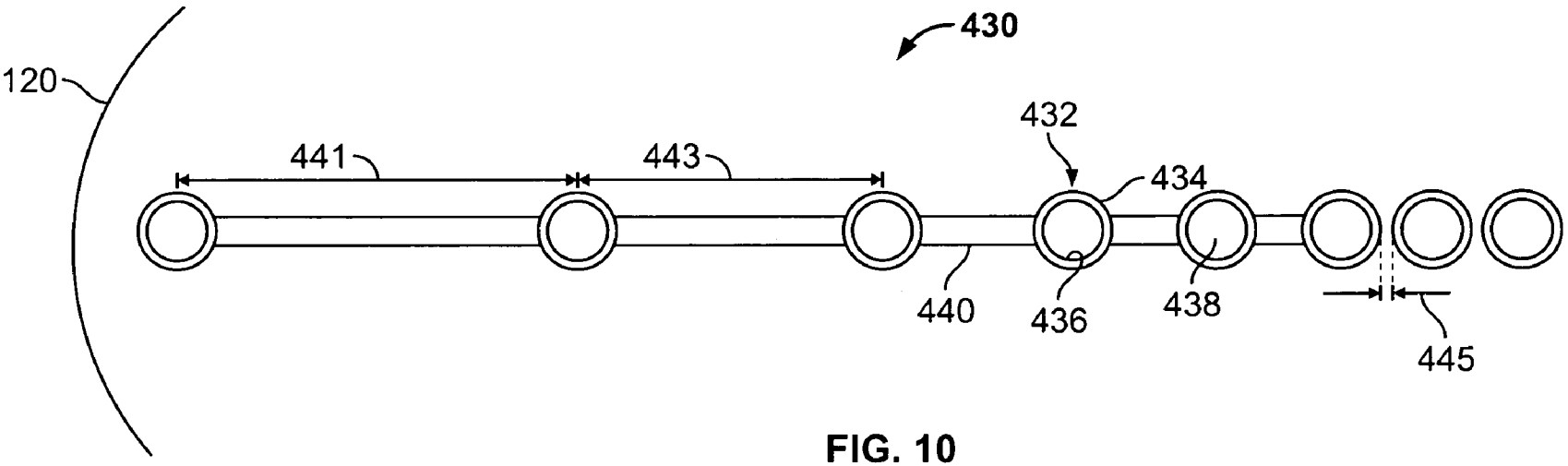
FIG. 10 is a cross-sectional plan-view of an alternative platen that may be used with the syngas cooler shown in FIG. 2.

FIG. 10 is a cross-sectional plan-view of an alternative platen 430 that may be used with syngas cooler 57 (shown in FIG. 2). Components of platens 430 that are identical to components of platens 130 are identified with the same reference numerals. Syngas cooler 57, in the exemplary embodiment, includes at least one platen 430 that extends generally radially from tube cage 120 towards center axis 114 (not shown in FIG. 10). Alternatively, each platen 430 may extend obliquely away from tube cage 120 at an angle θ (not shown in FIG. 10) that enables platen 430 to function as described herein. In the exemplary embodiment, each platen 430 includes a plurality of cooling tubes 432 that extend generally axially through syngas cooler 57. Each platen cooling tube 432 includes an outer surface 434 and an inner surface 436 that defines an inner passage 438 that extends through platen cooling tube 432 to enable feed water 72 to be channeled therethrough.

In the exemplary embodiment, at least one pair of adjacent platen cooling tubes 432 are coupled together using a web portion 440. More specifically, that pair of adjacent platen cooling tubes 432 are spaced a first distance 441 apart and form at least a portion of each platen 430. Moreover, at least one second pair of adjacent platen cooling tubes 432 are spaced a second distance 443 apart that is different than first distance 441. In addition, in the exemplary embodiment, at least one third pair of adjacent platen cooling tubes 432 are spaced a third distance 445 apart that is smaller than distances 441 and 443, such that no web portion 440 extends between the third pair of platen cooling tubes 432. The absence of a web portion 440 between platen cooling tubes 432 facilitates reducing the manufacturing time and costs of platens 430. Alternatively, at least one platen 430 may include a plurality of cooling tubes 432, wherein adjacent cooling tubes are spaced-apart a distance such that no web portions 440 extends between each adjacent cooling tube 432. In another embodiment, at least one platen 430 includes a plurality of cooling tubes 432 that are coupled together at discrete locations using at least one tie-bar that facilitates preventing each cooling tube 432 from moving relative to the other adjacent cooling tube 432. In the exemplary embodiment, platen cooling tubes 432 that are positioned generally near center axis 114 are spaced closer together than platen cooling tubes 432 that are positioned generally closer to tube cage 120. Alternatively, platen cooling tubes 432 that are positioned generally near center axis 114 may be spaced farther apart than platen cooling tubes 432 that are positioned generally closer to tube cage 120.

During operation, syngas 112 discharged from gasifier 56 into chamber 106 (not shown in FIG. 10) is generally discharged into syngas cooler 57 along center axis 114. As a result, the flow of syngas 112 is substantially greater near center axis 114 than adjacent to tube cage 120. In at least some known coolers, the platens include a plurality of cooling tubes that are equally spaced from adjacent-spaced cooling tubes. In the exemplary embodiment, at least one pair of platen cooling tubes 432 positioned near center axis 114 are spaced closer together than at least one other pair of platen cooling tubes 432 positioned closer to tube cage 120. As a result, the flow of syngas 112 is channeled past a greater number of cooling tubes 432 that are positioned near center axis 114 in comparison to known coolers. As such, positioning more platen cooling tubes 432 near center axis 114, in comparison to known coolers, facilitates increasing the heat transferred from the flow of syngas 112 to the flow of feed water 72. Moreover, and as described above, the overall length and/or radius $R_V$ of syngas cooler 57 is also facilitated to be reduced.

Figure 11:
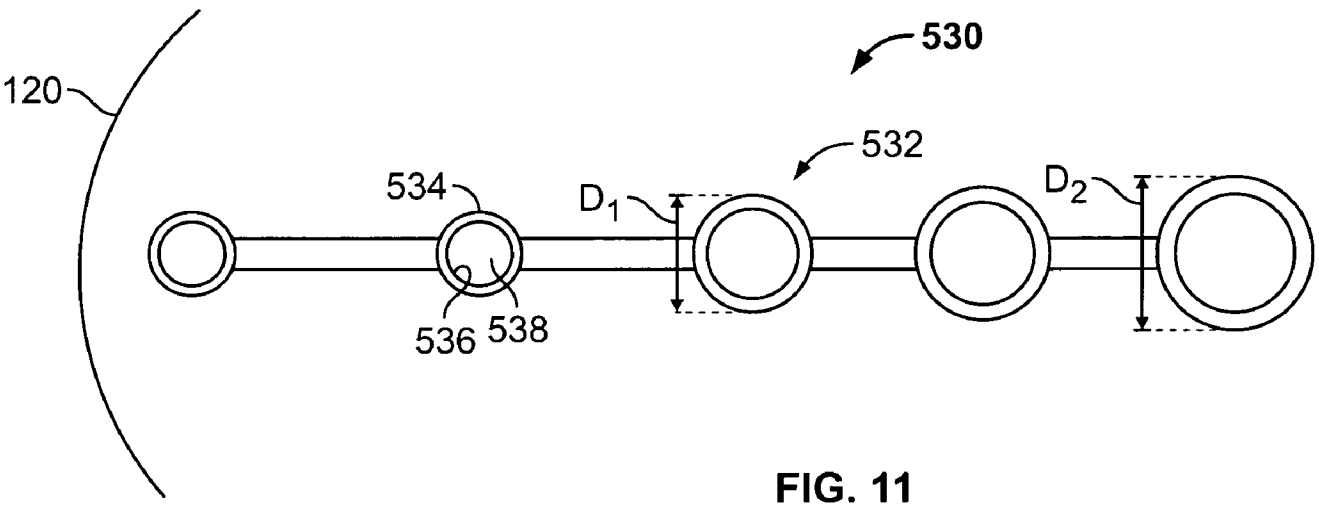
FIG. 11 is a cross-sectional plan-view of another alternative platen that may be used with the syngas cooler shown in FIG. 2.

FIG. 11 is a cross-sectional top-view of an alternative platen 530 that may be used with syngas cooler 57 (shown in FIG. 2). Components of platens 530 that are identical to components of platens 130 are identified with the same reference numerals. Syngas cooler 57, in the exemplary embodiment, includes at least one platen 530 that extends generally radially from tube cage 120 towards center axis 114 (not shown in FIG. 11). Alternatively, each platen 530 may extend obliquely away from tube cage 120 at an angle θ (not shown in FIG. 11) that enables tube cage 120 to function as described herein. In the exemplary embodiment, each platen 530 includes a plurality of cooling tubes 532 that each extends generally axially through syngas cooler 57. Each platen cooling tube 532 includes an outer surface 534 and an inner surface 536 that defines an inner passage 538 that channels cooling fluid generally axially therethrough. In the exemplary embodiment, at least one platen cooling tube 532 has a first diameter $D_1$ that is different than a second diameter $D_2$ of at least one other platen cooling tube 532. Specifically, in the exemplary embodiment, second diameter $D_2$ is larger than first diameter $D_1$. Moreover, in the exemplary embodiment, platen cooling tubes 532 having larger diameters are positioned closer to center axis 114 than cooling tubes 532 having smaller diameters. Alternatively, cooling tubes 532 may be positioned anywhere on platen 130 that enables tube cage 120 to function as described herein.

During operation, syngas 112 discharged from gasifier 56 into chamber 106 (not shown in FIG. 11) is generally discharged into syngas cooler 57 along center axis 114. As a result, the flow of syngas 112 is substantially greater near center axis 114 than tube cage 120. In the exemplary embodiment, at least one platen cooling tube 532 having a diameter $D_2$ is positioned closer to center axis 114 than at least one other platen cooling tube 532 having a diameter $D_1$. As a result, the flow of syngas 112 is channeled past at least one platen cooling tube 532 that has a larger diameter in comparison to known coolers. As such, positioning at least one platen cooling tube 532 that has a large diameter near center axis 114 in comparison to known coolers, facilitates increasing the heat transferred from the flow of syngas 112 to the flow of feed water 72, and as described above, also facilitates reducing the overall length and/or radius $R_V$ of syngas cooler 57.

Figure 12:
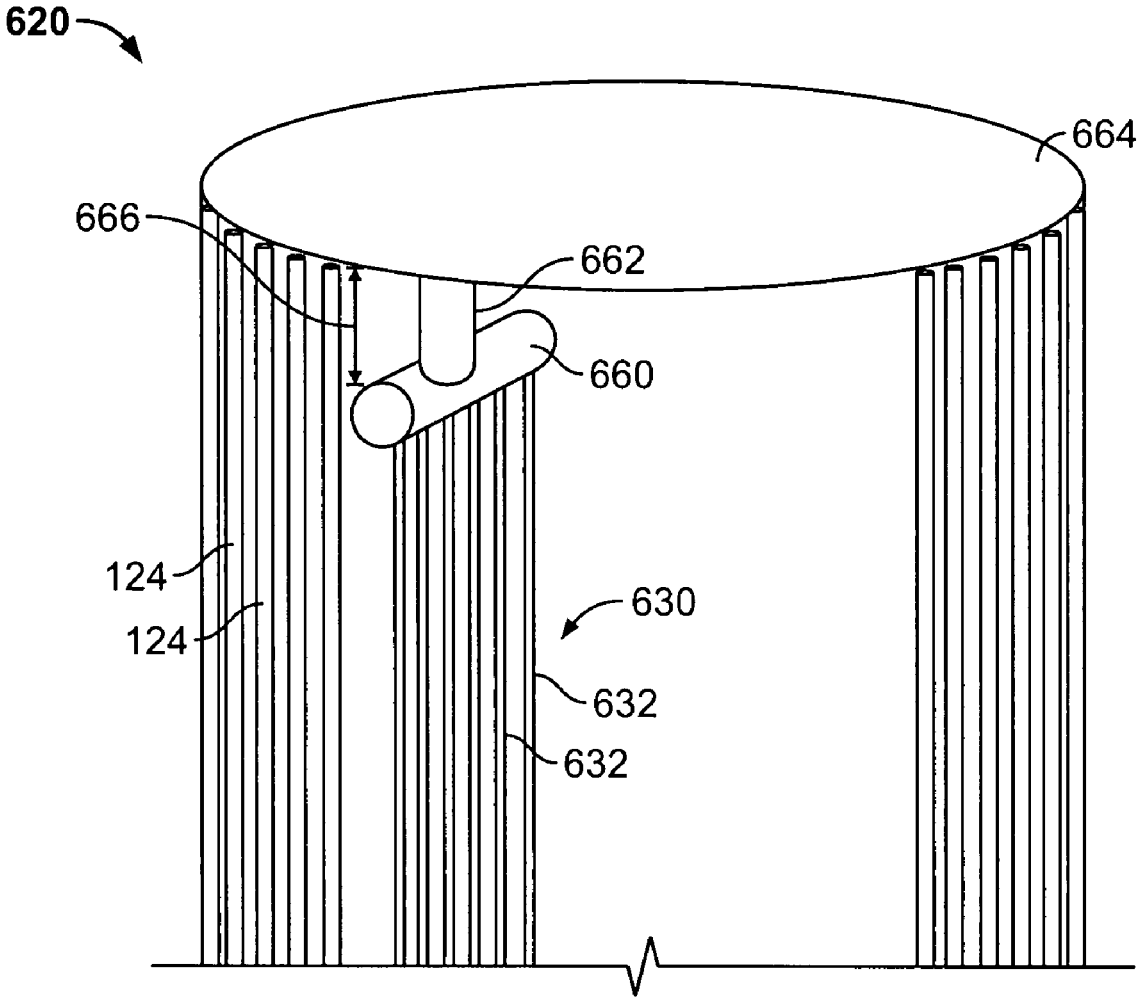
FIG. 12 is a perspective view of an alternative tube cage that may be used with the syngas cooler shown in FIG. 2.

FIG. 12 is a perspective view of an alternative tube cage 620 that includes at least one platen 630 that may be used with syngas cooler 57 (shown in FIG. 2). Components of tube cage 620 that are identical to components of tube cage 120 are identified with the same reference numerals. Specifically, in the exemplary embodiment, tube cage 620 is aligned substantially co-axially with center axis 114 and is formed with cooling tubes 124. Each platen 630 extends generally radially from tube cage 120 towards center axis 114 (not shown in FIG. 12). Alternatively, each platen 630 may extend obliquely away from tube cage 120 at an angle θ (not shown in FIG. 12) that enables platens 630 to function as described herein. In the exemplary embodiment, each platen 630 includes at least one cooling tube 132 as described above. Each platen cooling tube 132 is coupled in flow communication with a platen header 660 and a platen riser 662. In the exemplary embodiment, at least one platen header 660 is spaced a distance away from a tube cage top 664 such that a gap 666 is defined therebetween. As a result, at least one platen header 660 and a portion of at least one platen riser 662 are positioned within chamber 106 (not shown in FIG. 12).

During operation, in the exemplary embodiment, feed water 72 is channeled through each platen cooling tube 130 towards platen header 660. Syngas 112 discharged from gasifier 56 into chamber 106 is discharged into syngas cooler 57. In the exemplary embodiment, at least a portion of the syngas 112 is channeled past platen header 660 and platen riser 662, and more specifically, through gap 666. As a result, heat from syngas 112 is transferred from the flow of syngas 112 to the flow of feed water 72 channeled through platen header 660 and platen risers 662. As such, positioning at least one platen header 660 and platen riser 662 within chamber 106 facilitates increasing the heat transferred from the flow of syngas 112 to the flow of feed water 72, and as described above, facilitates reducing the overall length and/or radius $R_V$ of syngas cooler 57.

Exemplary embodiments of tube cages, platens, and cooling tubes including at least one cooling fin are described in detail above. The tube cages, platens, and cooling fins are not limited to use with the syngas cooler described herein, but rather, the tube cages, platens, and cooling fins can be utilized independently and separately from other syngas cooler components described herein. Moreover, the invention is not limited to the embodiments of the tube cages, platens, and cooling fins described above in detail. Rather, other variations of the tube cages, platens, and cooling fins may be utilized within the spirit and scope of the claims.

While the invention has been described in terms of various specific embodiments, those skilled in the art will recognize that the invention can be practiced with modification within the spirit and scope of the claims.

What is claimed is:

1. A method of assembling a radiant cooler, said method comprising:

providing a vessel shell that includes a gas flow passage defined therein that extends generally axially through the vessel shell;

coupling a plurality of cooling tubes and a plurality of downcomers together to form a tube cage wherein at least one of the plurality of cooling tubes is positioned circumferentially between a pair of circumferentially-adjacent spaced-apart downcomers;

extending a plurality of platens generally axially through the tube cage, wherein the plurality of platens are oriented such that at least a first of the plurality of platens is spaced a distance away from the tube cage that is different than a distance that at least a second of the plurality of platens is spaced from the tube cage; and orienting the tube cage within the vessel shell such that the tube cage is in flow communication with the flow passage.

2. A method in accordance with claim 1 further comprising positioning at least one platen header within the tube cage such that a gap is defined between the at least one platen header and a top of the tube cage.

3. A method in accordance with claim 1 wherein extending a plurality of platens generally axially through the tube cage further comprises extending a plurality of platens wherein at least one platen of the plurality of platens includes a plurality of cooling tubes.

4. A method in accordance with claim 1 further comprising extending at least one platen generally axially through the tube cage, wherein the at least one platen is oriented such that at least one of a platen top and a platen bottom extends obliquely away from the tube cage.

5. A method in accordance with claim 1 wherein extending a plurality of platens generally axially through the tube cage further comprises extending a plurality of platens wherein at least one platen of the plurality of platens includes a plurality of platen cooling tubes, wherein at least one of the plurality of cooling tubes has a diameter that is different than a diameter of at least one other of the plurality of cooling tubes.

6. A tube cage for use in a radiant cooler, said tube cage comprising:

a plurality of downcomers that extend substantially circumferentially about a center axis;

a plurality of cooling tubes that extend substantially circumferentially about said center axis, wherein at least one of said plurality of cooling tubes is positioned circumferentially between an adjacent pair of circumferentially-spaced downcomers; and a plurality of platens that extend generally axially through said tube cage, said plurality of platens oriented such that at least a first of said plurality of platens is spaced a distance away from said tube cage that is different than a distance that at least a second of said plurality of platens is spaced from said tube cage.

7. A tube cage in accordance with claim 6 wherein at least one platen of said plurality of platens comprises a plurality of cooling tubes.

8. A tube cage in accordance with claim 6 further comprising a plurality of platens that extend generally axially through said tube cage, at least one of said plurality of platens is oriented with respect to said tube cage such that at least one of a platen top and a platen bottom extends obliquely away from said tube cage.

9. A tube cage in accordance with claim 6 further comprising at least one platen that extends generally axially through said tube cage, said at least one platen comprises a plurality of cooling tubes oriented such that a space defined between a first pair of said plurality of cooling tubes is different than a space defined between a second pair of said plurality of cooling tubes.

10. A tube cage in accordance with claim 6 wherein at least one platen of said plurality of platens comprises a plurality of cooling tubes, at least one of said plurality of cooling tubes has a diameter that is greater than a diameter of at least one other of said plurality of cooling tubes.

11. A tube cage in accordance with claim 6 further comprising at least one platen header that is positioned a distance away from a top of said tube cage such that a gap is defined between the at least one platen header and said top of said tube cage.

12. A radiant cooler comprising:

a vessel shell that extends substantially circumferentially about a center axis; and a tube cage coupled within said vessel shell, said tube cage comprising:

a plurality of downcomers that extend substantially circumferentially about a center axis;

a plurality of cooling tubes that extend substantially circumferentially about said center axis, wherein at least one of said plurality of cooling tubes is positioned circumferentially between an adjacent pair of circumferentially-spaced downcomers; and a plurality of platens that extend generally axially through said tube cage, said plurality of platens oriented such that at least a first of said plurality of platens is spaced a distance away from said tube cage that is different than a distance that at least a second of said plurality of platens is spaced from said tube cage.

13. A syngas cooler in accordance with claim 12 wherein at least one platen of said plurality of platens comprises a plurality of cooling tubes.

14. A syngas cooler in accordance with claim 12 further comprising at least one platen header that is positioned a distance away from a top of said tube cage such that a gap is defined between said at least one platen header and said top of said tube cage.

15. A syngas cooler in accordance with claim 12 wherein at least one platen of said plurality of platens comprises a plurality of cooling tubes, at least one of said plurality of cooling tubes has a diameter that is greater than a diameter of at least one other of said plurality of cooling tubes.

16. A syngas cooler in accordance with claim 12 further comprising at least one platen that extends generally axially through said tube cage, said at least one platen comprises a plurality of cooling tubes oriented such that a space defined between a first pair of said plurality of cooling tubes is different than a space defined between a second pair of said plurality of cooling tubes.

17. A syngas cooler in accordance with claim 12 further comprising a plurality of platens that extend generally axially through said tube cage, at least one of said plurality of platens is oriented with respect to said tube cage such that at least one of a platen top and a platen bottom extends obliquely away from said tube cage.

* * * * *